United States Patent [19]

Chastagner

[11] Patent Number: 4,524,738

[45] Date of Patent: Jun. 25, 1985

[54] PROCESS AND DEVICE FOR CONTROLLING THE IDLING SPEED OF A HEAT ENGINE

[75] Inventor: Paul Chastagner, Les Clayes Sous Bois, France

[73] Assignee: Regie Nationale des Usines Renault, Boulogne Billancourt, France

[21] Appl. No.: 530,108

[22] Filed: Sep. 7, 1983

[30] Foreign Application Priority Data

Sep. 7, 1982 [FR] France ..... 82 15193

[51] Int. Cl.[3] ..... F02D 9/02; F02D 31/00

[52] U.S. Cl. ..... 123/339

[58] Field of Search ..... 123/339, 352, 361, 585

[56] References Cited

U.S. PATENT DOCUMENTS

| | | | |
|---|---|---|---|
| 3,645,241 | 2/1972 | Huntzinger | 123/352 |
| 4,401,073 | 8/1983 | Furuhashi | 123/340 X |
| 4,406,262 | 9/1983 | Ikeura | 123/349 X |
| 4,441,471 | 4/1984 | Kratt et al. | 123/340 X |
| 4,455,978 | 6/1984 | Atago et al. | 123/340 X |

*Primary Examiner*—Tony M. Argenbright

*Attorney, Agent, or Firm*—Oblon, Fisher, Spivak, McClelland & Maier

[57] ABSTRACT

A process and a device for controlling the idling speed of a heat engine with controlled ignition by modification of the airflow admitted to the intake manifold of the engine when predetermined idling conditions are detected, wherein the air flow modification is performed by a double-action actuator that causes the passage section of a bypass to vary in parallel with the ordinary gas butterfly or the position of the idling stop of this butterfly. A control signal for controlling the actuator is processed by a microprocessor which receives signals indicative of predetermined input parameters, including the primary current for ignition, and derives the control signal on the basis of the received signals. For each ignition pulse provided by the interruption of the primary ignition current, the period between ignition pulses is determined, as well as the slope of the period. Predetermined comparisons are made between the determined period and slope and an instruction period based on predetermined of the input parameters, and the results are algebraically processed, all by a microprocessor. A remainder is produced as a result of the algebraic processing, and this remainder is utilized in subsequent processing to enhance immunity from instabilities of the invention and to damp any significant period deviation in relation to an instruction value.

7 Claims, 2 Drawing Figures

PROCESS AND DEVICE FOR CONTROLLING THE IDLING SPEED OF A HEAT ENGINE

BACKGROUND OF THE INVENTION

1. Field of the Invention

This invention relates to the automatic control of the idling on autovehicles with controlled ignition.

2. Description of the Prior Art.

The objective in controlling idling speed is to keep an idling speed as near as possible to the instruction value and to return idling speed to the instruction value quickly without pumping when it deviates suddenly under the influence of an outside disturbance (variations of richness, advance, letting up on the accelerator, pulling of the power steering, etc.).

For that purpose, the quantity of air admitted into the intake manifold is affected by using an actuator that operates, either by causing the section of a bypass to vary, or by more or less half opening the butterfly, the standard idling stop then being made mobile.

At idling, engines are often the site of intrinsic pumping phenomena (gaps in richness due to the oxygen probe, ignition jumps, richness-filling resonance, etc.). It does not pertain to the control of the idling speed to eliminate them, that is the job of the engine mechanics. On the other hand, the process of governing the control must be careful not to amplify them, while strictly correcting any deviation of speed in relation to the instruction.

These processes are already known, but these prior processes exhibit the following drawbacks:

Either they work with speed and the latter is expensive to obtain in time and in loading of memory, or they work with periods, and nothing intrinsic in the basic algorithm filters the insignificant variations from one cycle to the other.

They do not offer, as does this invention, the possibility of passing, almost without modifications, from one type of actuator to another (double-pole continuous motor to a stepping motor).

The time of a corrective command of the actuator can exceed the period separating two consecutive ignitions. A complex management of times results for the microprocessor and the integration with an injection-ignition process is difficult under these conditions.

In the absence of integral effect, on the one hand, the accuracy on the final value attained is poor and, on the other hand, an unfortunate propensity for amplifying the instabilities of the engine is noted.

The output to the actuator is complex, therefore hard to manage. For example, it comes down to the proportional effect of deciding or not on a corrective pulse while the differential effect receives the role of controlling the amplitude.

Their basic strategy does not implicitly have an anti-overshoot effect during the returns to the instruction value on letting up on the accelerator.

SUMMARY OF THE INVENTION

The objects of the invention are to eliminate the preceding drawbacks and to take control of speed at idling of automobile engines with controlled ignition, simply, economically, reliably and with a good immunity from the instabilities of the engine.

These and other objects are achieved according to the invention by providing a novel process for controlling the idling speed of a heat engine with controlled ignition by modification of the air flow admitted to the intake manifold when idling conditions are detected, this modification being performed essentially by a double-action actuator that causes the passage section of a bypass to vary in parallel with the ordinary gas butterfly or the position of the idling stop of this butterfly, the control signal of the actuator being processed by a microprocessor receiving the signals of predetermined input parameters, particularly a signal indicative of the primary current for ignition, wherein at each ignition pulse provided by the interruption of the primary current, (a) the contents of a clock signal counter are stored in a PERIOD memory, after the contents of the PERIOD memory have been transferred into a PRECEDING PERIOD memory, then the clock signals counter is reset to zero;

(b) an INSTRUCTION PERIOD is determined, for example, by a table of values, as a function of the input parameters, particularly of the temperature of the cooling water of the engine;

(c) a DEVIATION between the stored period and the instruction period is determined;

(d) a THRESHOLD is determined, for example, by a table of values, as a function of the deviation;

(e) a SLOPE is determined as a difference between the period and the preceding period;

(f) a maximum slope (MAXSLOPE) is optionally determined (if the deviation is negative and at least if the slope is positive), also as a function of the deviation;

(g) if the deviation is positive or zero, or the slope is negative or zero, or further if the slope is less than or equal to said maximum slope, a WEIGHTED SLOPE is optionally determined, produced from the slope by a number (N) of predetermined weight, a new value of a sum (SUM) is computed by adding the deviation and optionally the weighted slope algebraically to the preceding value of this magnitude, and the absolute value of this new value (SUM) is compared to the threshold;

(h) a REMAINDER is optionally determined (if said absolute value is greater than or equal to the threshold) as a difference between the sum (SUM) and the threshold;

(i) finally, as a function of the various comparisons between these various values it is determined whether or not a control signal must be sent to the actuator and in what direction, before transfering the remainder into the memory of the sum to recommence a new cycle while waiting for a new ignition interruption.

As above noted, the period that passes between two successive ignitions constitutes the main input parameter of the digital control device that processes the control signal of the actuator by the process according to the invention.

Auxiliary parameters such as raised foot contact, pressure in the intake manifold, water temperature, potentiometer on the butterfly pin, (a nonexhaustive list) are used only to adapt the conditions to practical use of the control process (suspension of operation under load or at deceleration, etc.) or to expand its initial function (cold start, damping, etc.).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
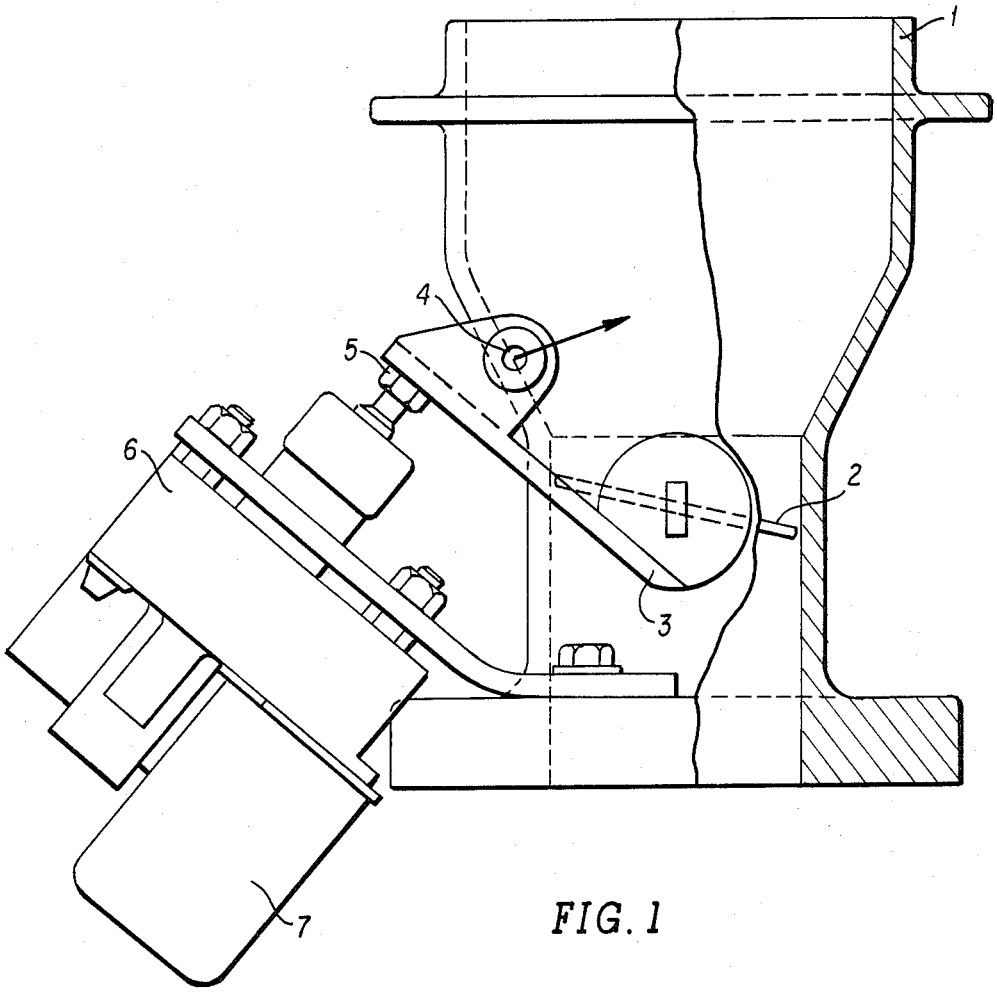
FIG. 1 is a side view, partially in cross-section, of a control element.

There is seen in FIG. 1 the butterfly housing-mechanical actuator unit. A butterfly flap 2, mounted in butterfly housing 1, is caused to rotate by lever 3 on which the accelerator control is attached at 4. The closing of the butterfly is limited by idling stop 5, mobile in translation under the action of the reducer-movement transformer stage 6, moved by motor 7.

The invention aims at digitally making an automatic control of the idling speed for a type simulating a control known as "proportional-integral-differential", a type that will be designated below by "pseudo-P.I.D.", so as to benefit from the advantages of this type control, i.e., to exhibit a better immunity from the instabilities of the engine, and to correct by strongly damping any significant period deviation in relation to an instruction value.

At each ignition, the situation is reevaluated. Depending on the result of the computation, the microprocessor, with the actuator, orders or not a correction in the appropriate direction and of a predetermined amplitude:

one (or more) step(s), in the case of a stepping motor;

a conduction time in the case of a double-pole motor.

According to a characteristic of the invention, the number of steps or the conduction time are fixed in advance, independently of the process according to the invention. The invention determines only whether or not a basic corrective action should be produced by the actuator and defines its direction. Consequently, there is a great flexibility for adaption to the various types and characteristics of actuators and a good compatability with the existing injection-ignition softwares.

Figure 2A:
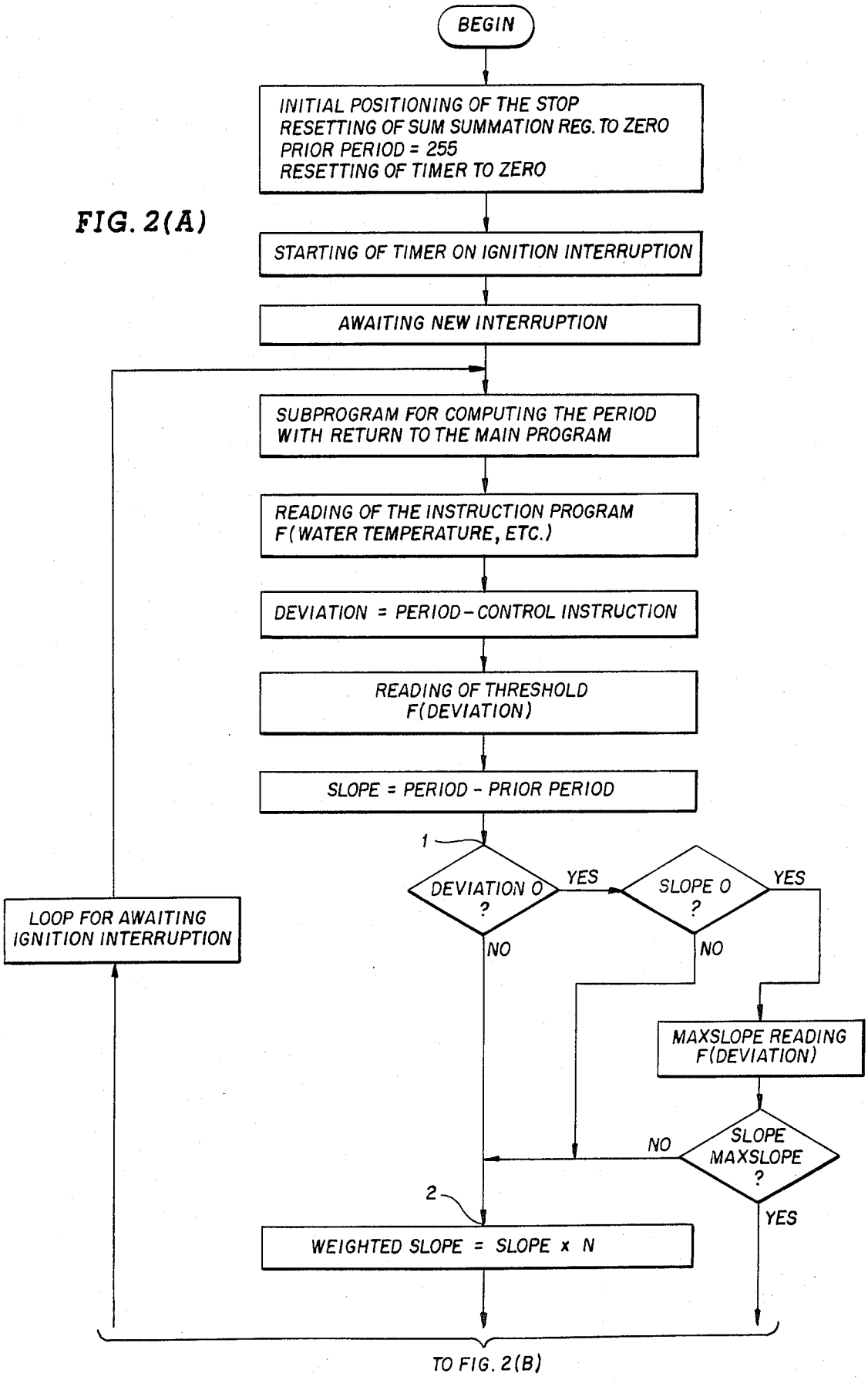
FIG. 2 is a flowchart of the process according to the invention.
Figure 2B:
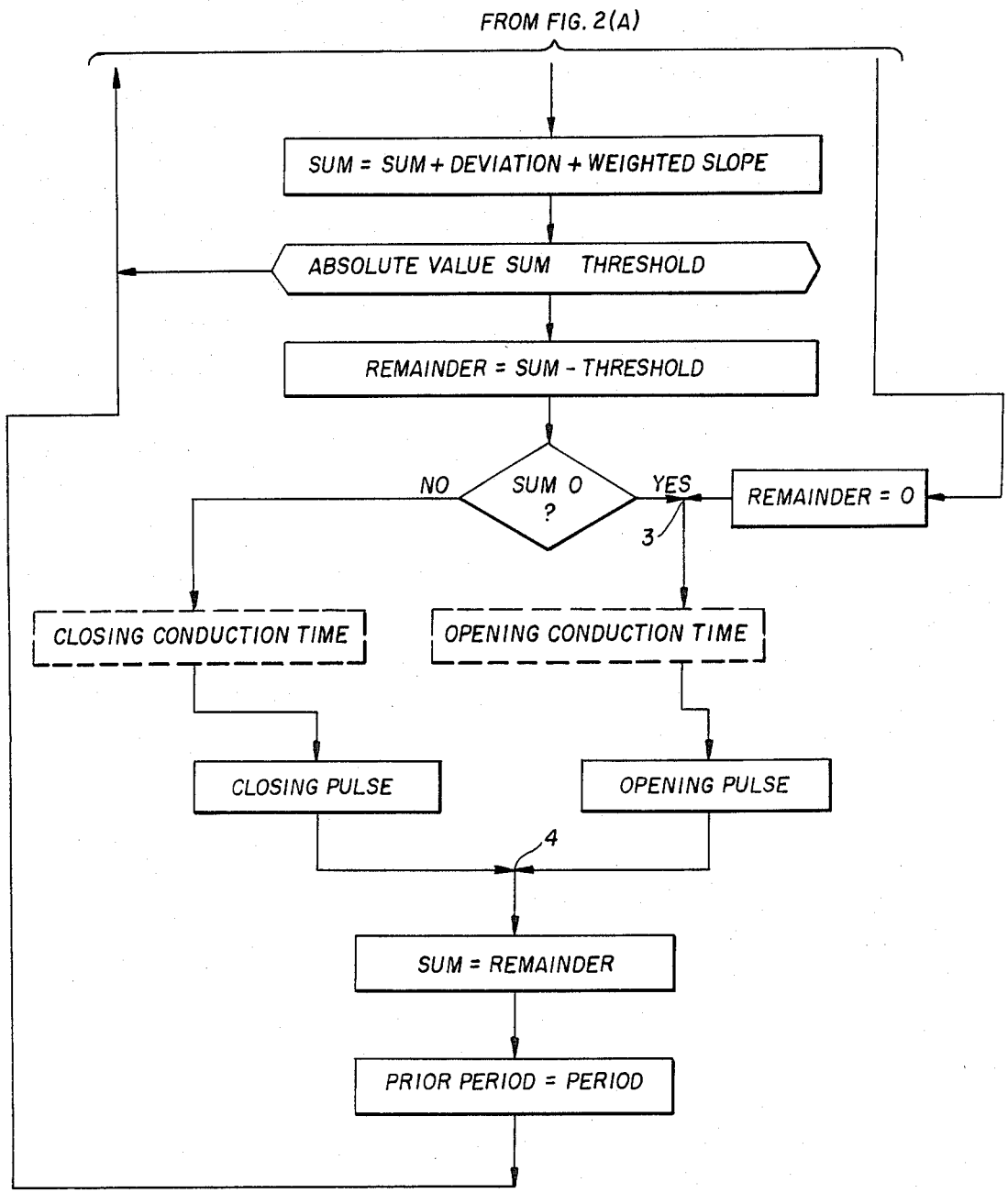

When the various required initializations have been performed and if, moreover, the multiple data received by the microprocessor make it possible for it to consider the engine as being under the conditions for controlling the idling, while at each occurrence of an interruption of the primary current for ignition, the microprocessor passes through the flowchart of FIG. 2 whose various phases will be examined:

Subprogram for processing ignition interruptions:

Computation of the PERIOD elapsed between the last two ignitions.

Modification of the address and the stack pointer for return to the main program.

Reading in a table of the INSTRUCTION period. It is a function of the water temperature and optionally other parameters.

Computation of the DEVIATION: DEVIATION=PERIOD−INSTRUCTION.

Reading in a THRESHOLD table. The larger the DEVIATION will be in relation to the instruction, the smaller the overflow THRESHOLD of the SUM integration register will be to obtain the proportional effect.

Computation of the: SLOPE=PERIOD−PRIOR PERIOD.

Branch point No. 1.

Branch point No. 2.

Computation of the WEIGHTED SLOPE:

$$\text{WEIGHTED SLOPE}=\text{SLOPE}\times N$$

N, the weight coefficient, makes it possible to give more or less weight to the differential effect. Preferably, a power of 2 is selected. A saturation of the WEIGHTED SLOPE should be provided so that the result can be expressed with the number of bits of the integration register.

Computation of the value of the SUM integration register:

$$\text{SUM}=\text{SUM}+\text{DEVIATION}+\text{WEIGHTED SLOPE}$$

Test on the absolute value of SUM:

If $|\text{SUM}|<\text{THRESHOLD}$ then, wait for the next ignition interruption.

If $|\text{SUM}|\geqq\text{THRESHOLD}$ continue in sequence.

Test on the relative value of SUM:

If $\text{SUM}\geqq 0$ go to branch point No. 3.

If $\text{SUM}<0$ continue in sequence.

If the actuator is a double-pole continuous motor, load the closing conduction time.

Order a closing pulse to the actuator.

Branch point No. 4.

Do: SUM=REMAINDER.

Do: PRIOR PERIOD=PERIOD.

Await the next ignition interruption.

Branch point No. 3:

If the actuator is a double-pole continuous motor.

load the opening conduction time.

Order an opening pulse to the actuator.

Go to branch point No. 4.

Branch point No. 1:

If $\text{DEVIATION}\geqq 0$ go to branch point No. 2.

If $\text{DEVIATION}<0$, a test is performed on the relative values of SLOPE:

If $\text{SLOPE}<0$ go to branch point No. 2,

If $\text{SLOPE}>0$, the maximum allowable SLOPE (MAXSLOPE) as a function of the deviation is read in a table. Actually, if the rotation speed decreases very rapidly while being slightly greater than the instruction, it can be feared that there will be an overshoot and even setting. Hence, as a function of the DEVIATION a SLOPE VALUE not to be overshot.

Test on the SLOPE value:

If $\text{SLOPE}\leqq\text{MAXSLOPE}$ go to branch point 2.

If $\text{SLOPE}>\text{MAXSLOPE}$ continue in sequence.

Do: REMAINDER=0.

Go to point No. 3.

The above-mentioned algorithm, as will be seen, makes an automatic control of speed of the pseudo P.I.D. type.

The instruction "SUM=SUM+DEVIATION" constitutesl the INTEGRAL effect. It prevents the microprocessor from being abused by cyclical dispersions and low-amplitude pumpings, which are cancelled algebraically by summation.

The judicious choice of the THRESHOLD value creates a delay that makes it possible to take into account the delay of the system.

The decrease of the THRESHOLD value as a function of the DEVIATION produces the PROPORTIONAL effect, a reaction that is stronger the farther away from the instruction.

There is no question that, if it is necessary and without changing the general philosophy of the invention, the operation can be made asymmetrical by creating a THRESHOLD for the positive overshoots and a THRESHOLD for the negative overshoots.

The instruction "SUM=SUM+DEVIATION+-WEIGHTED SLOPE" (when N is different from zero) constitutes the MAIN DIFFERENTIAL effect. The comparison of the SLOPE with a maximum allowable slope (MAXSLOPE) when the PERIOD increases toward the instruction is only a marginal safety aspect of it in certain cases of operation. The same process can be applied symmetrically, if necessary when the PERIOD decreases toward the INSTRUCTION.

The derived action minimizes:

The deviation in relation to the proportional action when the system deviates suddenly from the instruction value;

the overshoot during the return to the instruction value (damping).

According to another characteristic of the invention, and therein lies the advantage, the control of the actuator is performed in the sole form of "a basic corrective action."

In the case of a double-pole continuous motor, this action can be of different amplitude (conduction time) depending on whether it opens or closes the butterfly. In one case, the return spring is stretched, in the other case, it is slack which causes unequal forces. Also, a variation of the battery voltage can justify a modification of the intensity of this basic action.

But, in any case, the calibration of the conduction time is performed outside the control process according to the invention. Most often, this time is a constant. The result constitutes the "basic corrective action."

After ignition, it is the role of the invention to decide whether or not the application of a "basic corrective action" is needed and in the desired direction.

The same applies to a stepping motor, the number of steps acting, in this case, as the conduction time for the determination of the "basic corrective action."

The technical characteristics can be selected so as to be able to be satisfied by a number of steps that are constant and equal to 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for controlling the idling speed of a heat engine with controlled ignition by modification of air flow admitted to an intake mainfold of the engine when predetermined idling conditions are detected, said modification of air flow being performed by a double-action actuator that causes a passage section of a bypass to vary in parallel with a gas butterfly or a position of an idling stop of said butterfly, wherein a control signal for controlling the actuator according to an instruction value is processed by a microprocessor receiving signals associated with pedetermined input parameters, including a signal indicative of a primary current for ignition, and wherein for each ignition pulse provided by the interruption of the primary current the process comprises:

(a) counting clock signals by means of a counter, storing the contents of the counter in a period memory, after the contents of the period memory have been transferred into a preceding period memory, and then resetting the clock signals counter to zero;

(b) determining an instruction period from a table of values, as a function of said predetermined input parameters, including the temperature of the cooling water of the engine;

(c) determining a deviation between the stored period and the instruction period;

(d) determining a threshold from a table of values, as a function of the deviation;

(e) determining a slope as a difference between the period and the preceding period;

(f) determining a maximum slope, if the deviation is negative and at least if the slope is positive, also as a function of the deviation;

(g) if the deviation is positive or zero, or if the slope is negative or zero, or further if the slope is less than or equal to said maximum slope, determining a weighted slope produced from the slope by a number (N) of predetermined weight, computing the new value of a sum by adding the deviation and the weighted slope algebraically to the preceding value of this sum, and comparing the absolute value of this new value with the threshold;

(h) determining a remainder, if said absolute value is greater than or equal to the threshold, as a difference between the sum and the threshold; and (i) determining, as a function of predetermined comparisions between the above-determined values, whether or not said control signal, which represents a predetermined basic corrective action, should be sent to the actuator and in what direction, before memorizing the remainder as the sum to recommence a new cycle while awaiting a new ignition interruption.

2. A control process as in claim 1, further comprising:

choosing an average value and a law of variation of the threshold so that, said average value produces a constant delay, and so that the variation is countervariant with the deviation to product a suitable proprotional effect.

3. A controll process according to claim 2, wherein the value of the weighting number (N) and the average value and the law of variation of the maximum slope are chosen to produce a predetermined damping differential effect.

4. A control process according to claim 3, comprising:

using the operation of addition of the weighted slope when the deviation is negative and the slope positive, defined as occuring when the period increases toward the instruction value, and also when the deviation is positive and the slope negative, defined as occuring when the period decreases toward the instruction value.

5. A device for controlling the idling speed of a heat engine with controlled ignition by modification of air flow admitted to an intake maninfold of the engine when predetermined idling conditions are detected, said modification of air flow being performed by an actuator, wherein a control signal for controlling the actuator according to an instruction value is processed by a microprocessor receiving signals associated with predetermined input parameters, including a signal indicative of a primary current for ignition, comprising:

sensors for producing detection signals indicative of said predetermined input parameters and for applying said detection signal to said microprocessor;

wherein for each ignition pulse provided by the interruption of the primary current said microprocessor performs the following processing functions, counting clock signals by means of a counter, storing the contents of the counter in a period memory, after the contents of the period memory have been transferred into a preceding period memory, and then resetting the clock signals counter to zero, determining an instruction period from a table of values, as a function of said predetermined input parameters, including the temperature of the cooling water of the engine, determining a deviation between the stored period and the instruction period, determining a threshold from a table of values, as a function of the deviation, determining a slope as a difference between the period and the preceding period, determining a maximum slope, if the deviation is negative and at least if the slope is positive, also as a function of the deviation, if the deviation is positive or zero, or if the slope is negative or zero, or further if the slope is less than or equal to said maximum slope, determining a weighted slope produced from the slope by a number (N) of predetermined weight, computing the new value of a sum by adding the deviation and the weighted slope algebraically to the preceding value of this sum, and comparing the absolute value of this new value with the threshold, determining a remainder, if said absolute value is greater than or equal to the threshold, as a difference between the sum and the threshold and determining, as a function of predetermined comparisons between the above-determined values, whether or not said control signal, which represents a predetermined basic corrective action, should be sent to the actuator and in what direction, before memorizing the remainder as the sum to recommence a new cycle while awaiting a new ignition interruption; and said actuator comprising a double-action actuator controlled by said control signal for varying a passage section of a bypass in parallel with a gas butterfly or a position of an idling stop of said butterfly.

6. A device according to claim 5, wherein the actuator comprises:

a continuous reaction motor having two operating directions, and wherein the corrective action sent or not by the microprocessor comprises a signal indicative of a predetermined conduction time predetermined independent of processing by said microprocessor, either in the closing or opening direction.

7. A device according to claim 5, wherein the actuator comprises:

a stepping motor with two operating directions, and wherein the corrective action sent by the microprocessor comprises a predetermined number of pulses indicative of a closing or opening direction.

* * * * *